US006484907B1

(12) United States Patent
Evans

(10) Patent No.: US 6,484,907 B1
(45) Date of Patent: Nov. 26, 2002

(54) PORTABLE AUTOMATIC FLUID DISPENSER

(76) Inventor: Daniel J. Evans, 1752 Fayette Walk, Unit A, Hoffman Estates, IL (US) 60195

( * ) Notice: Subject to any disclaimer, the term of this patent is extended or adjusted under 35 U.S.C. 154(b) by 0 days.

(21) Appl. No.: 09/505,979

(22) Filed: Feb. 16, 2000

(51) Int. Cl.[7] ..... B67D 5/00

(52) U.S. Cl. ..... 222/334; 222/61

(58) Field of Search ..... 222/61, 63, 175, 222/333, 334, 373, 608; 239/152, 154, 337, 340, 346, 373; 141/67

(56) References Cited

U.S. PATENT DOCUMENTS

| | | | | | |
|---|---|---|---|---|---|
| 2,281,142 | A | | 4/1942 | Davis | |
| 2,382,426 | A | * | 8/1945 | Kocher | 222/333 |
| 2,515,568 | A | | 7/1950 | Pharo | |
| 2,521,313 | A | * | 9/1950 | Sproat | 239/373 |
| 3,979,023 | A | | 9/1976 | Hartley | 222/61 |
| 4,135,669 | A | * | 1/1979 | Bridges et al. | 239/373 |
| 4,214,674 | A | | 7/1980 | Jones | |
| 4,228,933 | A | | 10/1980 | Elson | |
| 4,456,149 | A | | 6/1984 | Sciortino | |
| 4,591,071 | A | | 5/1986 | Johnson | |
| 4,768,714 | A | * | 9/1988 | Luchsinger | 222/175 |
| 4,801,088 | A | | 1/1989 | Baker | 239/152 |
| 5,154,317 | A | | 10/1992 | Roppolo | 222/66 |
| 5,603,361 | A | | 2/1997 | Cuisinier | 141/26 |
| 5,810,213 | A | * | 9/1998 | Flores et al. | 239/373 |
| 5,931,207 | A | | 8/1999 | Gianino | 141/382 |
| 5,964,403 | A | * | 10/1999 | Miller et al. | 239/373 |

FOREIGN PATENT DOCUMENTS

WO WO 95/022125 1/1995

OTHER PUBLICATIONS

"Catching Fluid Power—Hydraulic and Pneumatic", p. 1085, 1996 (referencing Parker Filters, Model Nos. 15P, 30P and 30PD).
"5 Gallon Fluid Dispensers with MALABAR 'HS'—Tanks" MALABAR International, 1999.
Communication from MALABAR International, Jan. 3, 2000 (referencing Apr. 1998 disclosure of Malabar Battery Operated 5 Gallon Dispenser).
"Spring 2000 Master Catalog No. 146" Northern Tool Equipment Co., p. 41, 2000 (referencing Galaxy fluid spray gun).
"2000–2001 Catalog No. 391" Grainger, p. 1821, 2000 (referencing Aro Pak grease dispenser).
"Instructions—Part List for Standard EMS Electronic Metered Dispense Valves" 1996.
"Catching Fluid Power—Hydraulic and Pneumatic", p. 1141, 1996 (Referencing Arrow POA4 Adjustable Pressure Switch).

* cited by examiner

*Primary Examiner*—J. Casimer Jacyna
(74) *Attorney, Agent, or Firm*—Patzik, Frank & Samotny Ltd.

(57) ABSTRACT

A portable fluid dispensing apparatus comprising an fluid reservoir, an air compressor, and a dispensing gun. The fluid reservoir is fitted with a pressure switch which regulates the pressure within said fluid reservoir. Once fluid is charged into the fluid reservoir, the air compressor is activated to pressurize said fluid reservoir and the apparatus is ready for use. The fluid dispenser is then transported to the servicing site. An operator pulls the trigger on the dispenser gun for delivery of fluid on demand. When the pressure in the fluid reservoir drops, the air compressor is automatically triggered to raise the pressure to the predetermined set point. The fluid reservoir may be replenished with fluid as needed by simply depressurizing the fluid reservoir, refilling and repressurizing same. The fluid dispenser may additionally be fitted with a manually operated pump. The fluid reservoir may also be thermally insulated with heat tape to maintain the desired viscosity of the fluid contained therein.

25 Claims, 11 Drawing Sheets

PORTABLE AUTOMATIC FLUID DISPENSER

BACKGROUND OF THE INVENTION

1. Field of the Invention

The present invention relates to fluid dispensers, and, more particularly, to a portable automatic fluid dispenser which delivers an accurate amount of fluid in a safe and efficient manner.

2. Description of the Prior Art

When servicing engines, servicing personnel must work safely, quickly and efficiently to reduce costs and maximize profits.

In the past, service personnel in charge of apparatus fluid management and maintenance had to handle hundreds, if not thousands, of individual fluid containers for delivery of fluid to a particular device. If a servicing operation has to be done in the field, the operator has to physically carry several containers to the site. The weight of the fluid filled containers in combination with the awkward manner of toting is physically challenging and can be injurious to servicing personnel.

Moreover, individual fluid containers are expensive, and the empty containers must be disposed of in land fills. This creates environmental concerns.

Once at the site, the servicing personnel has to open each individual container and pour the fluid into the device to be serviced. This is not only time consuming, but it also creates a hazardous situation when the fluid spills on the ground creating a slippery surface. The possibility of overfilling and/or spilling is also a constant concern due to the inability to accurately control fluid delivery.

To ease the burden on servicing personnel, filling stations have been developed. The apparatus or device to be serviced is brought to the servicing station. While this has reduced the physical strain experienced by the personnel, it is impractical in certain situations due to the size and maneuverability limitations of the device to be serviced. This method is also time consuming because the device has to be brought to and moved out of the servicing station each time it needs servicing.

Therefore, what is needed is a fluid dispenser which minimizes spillage of fluid thereby resulting in a safer working environment. Additionally, the fluid dispenser should be lightweight and transportable in a manner whereby the physical injury to an operator is eliminated. Furthermore, it is desired that the fluid dispenser be efficient so that service personnel may service more devices in less time. Finally, what is needed is a fluid dispenser which is environmentally friendly by eliminating the waste, such as empty can and bottles, that ultimately end up in land fills.

SUMMARY OF THE INVENTION

What is disclosed is a portable fluid dispenser that is comprised of at least a fluid container or reservoir, an air compressor, and a dispenser gun. The fluid container is filled with the desired fluid suitable for a particular application. Next, the air compressor is activated and the fluid container is pressurized up to a predetermined set point. The fluid dispenser is then transported to the place of operation. Finally, when an operator is ready to dispense the fluid, a trigger of the dispenser gun is activated and the fluid is dispensed.

As the fluid is dispensed, the pressure within the container decreases due to an increase in volume or head space. This decrease in pressure is detected by a pressure switch which then activates the air compressor. The air compressor then pressurizes the fluid container back up to the set point so that a constant fluid flow is maintained.

Optionally, the fluid dispenser may be fitted with a manually operated pump to pressurize the fluid container. This option is provided so that in case of power or mechanical failure, the operator may manually pressurize the fluid container and continue servicing operations.

The fluid dispenser may also be insulated with heat tape. The heat tape ensures that the temperature of the fluid within the fluid container maintained at a predetermined value. This is a particularly useful feature if the fluid dispenser is operated in colder climates or in the winter season. As temperature decreases, the fluid viscosity may increase. With the heat tape, however, the fluid temperature may be maintained at a predetermined value to maintain the viscosity desired.

With the fluid dispenser of the present invention, fluid may be safely and efficiently delivered.

Therefore it is an object of the invention to provide an apparatus which can accurately deliver fluid thereby avoiding a overfill situations that create a hazardous condition.

Another object of the invention to provide an economical apparatus that uses fluid from cheaper bulk sources, such as a drums, rather than individual cans which are costly.

Yet another object of the present invention is to provide an apparatus that is environmentally friendly by using fluid from a bulk source such as a drum thereby cutting back the need for dispensing numerous empty cans or bottles in land fills.

Still another object is to provide an apparatus which safely delivers fluid by avoiding spills which may occur by conventional methods of fluid delivery such as pouring the fluid out of a can or bottle.

BRIEF DESCRIPTION OF THE DRAWINGS

A more complete understanding of the invention can be obtained by considering the flowing detailed description in conjunction with the accompanying drawings, in which.

DETAILED DESCRIPTION OF THE PREFERRED EMBODIMENT

Figure 1:
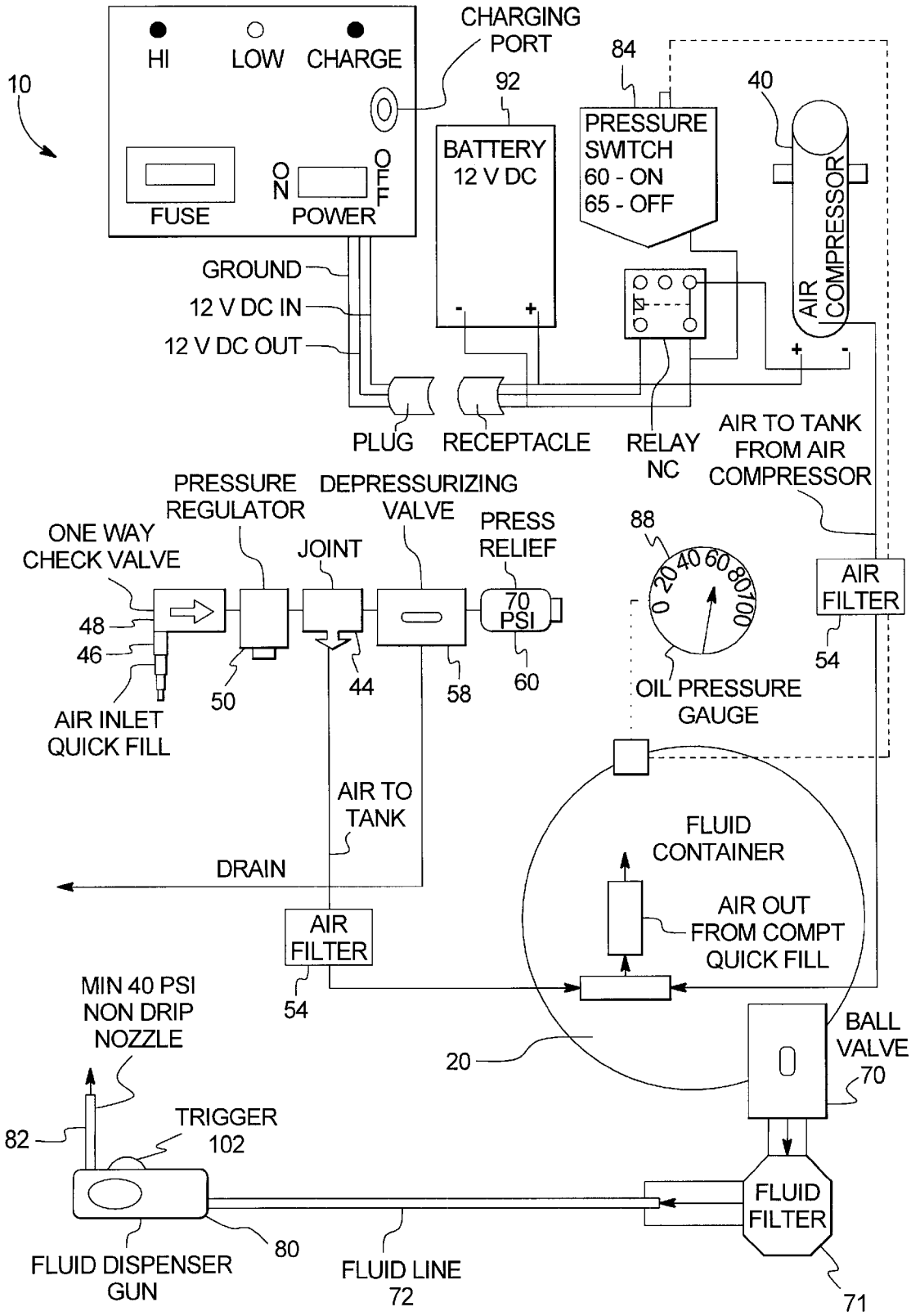
FIG. 1 is a schematic diagram of the fluid dispenser of the present invention.

While this invention is susceptible of embodiment in many forms, there is shown in the drawings, and will be described in detail herein, a preferred embodiment, with the understanding that the present disclosure is to be considered an example of the principles of the invention and is not intended to limit the invention to the embodiment illustrated.

Turning now to the drawings, and more particularly to FIG. 1, a portable fluid dispenser is shown generally at 10. Fluid dispenser 10 is mainly comprised of three components, namely, fluid container 20, air compressor 40, and dispenser gun 80.

Figure 2:
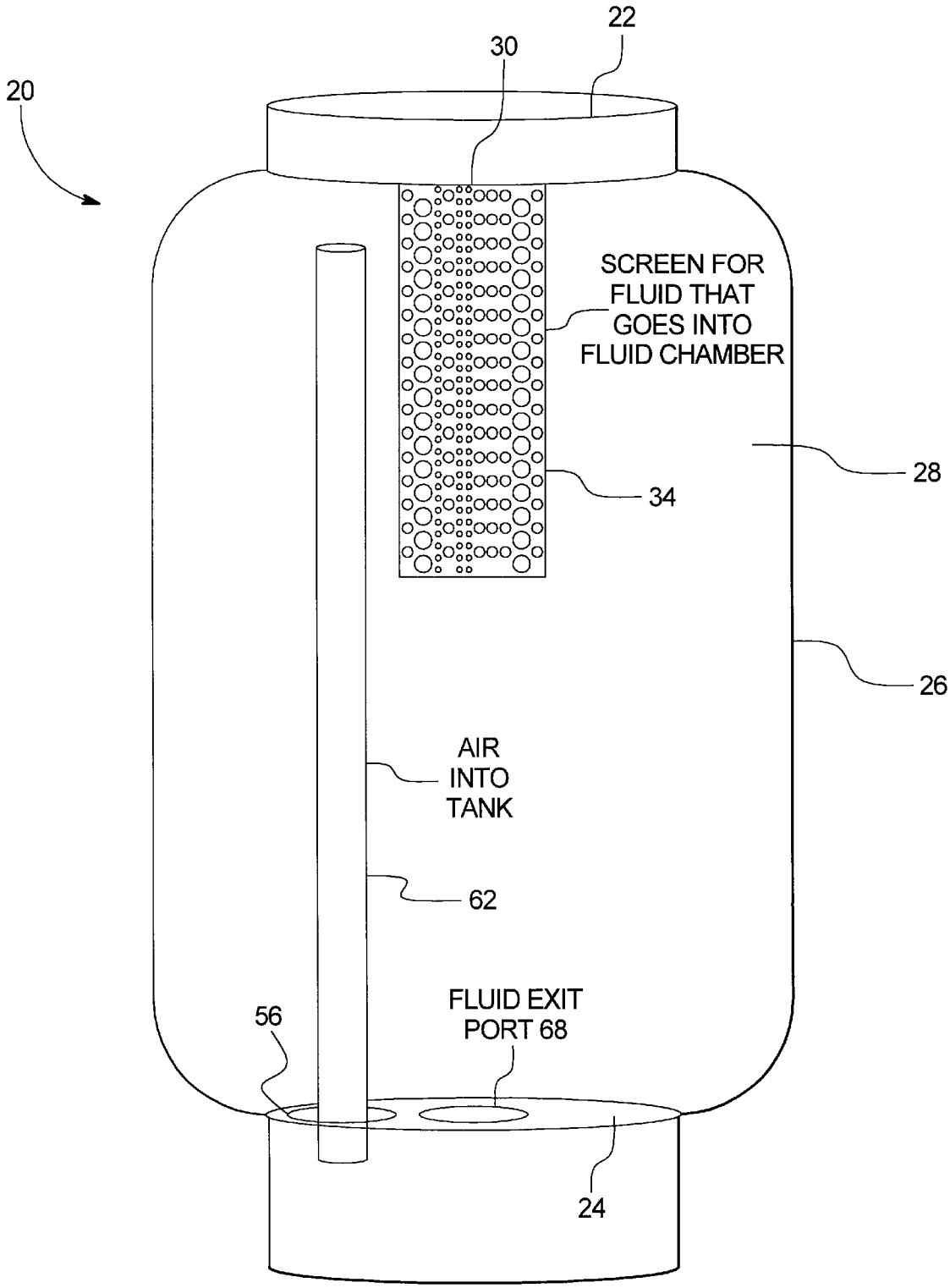
FIG. 2 is a side elevational view of a fluid container.
Figure 2A:
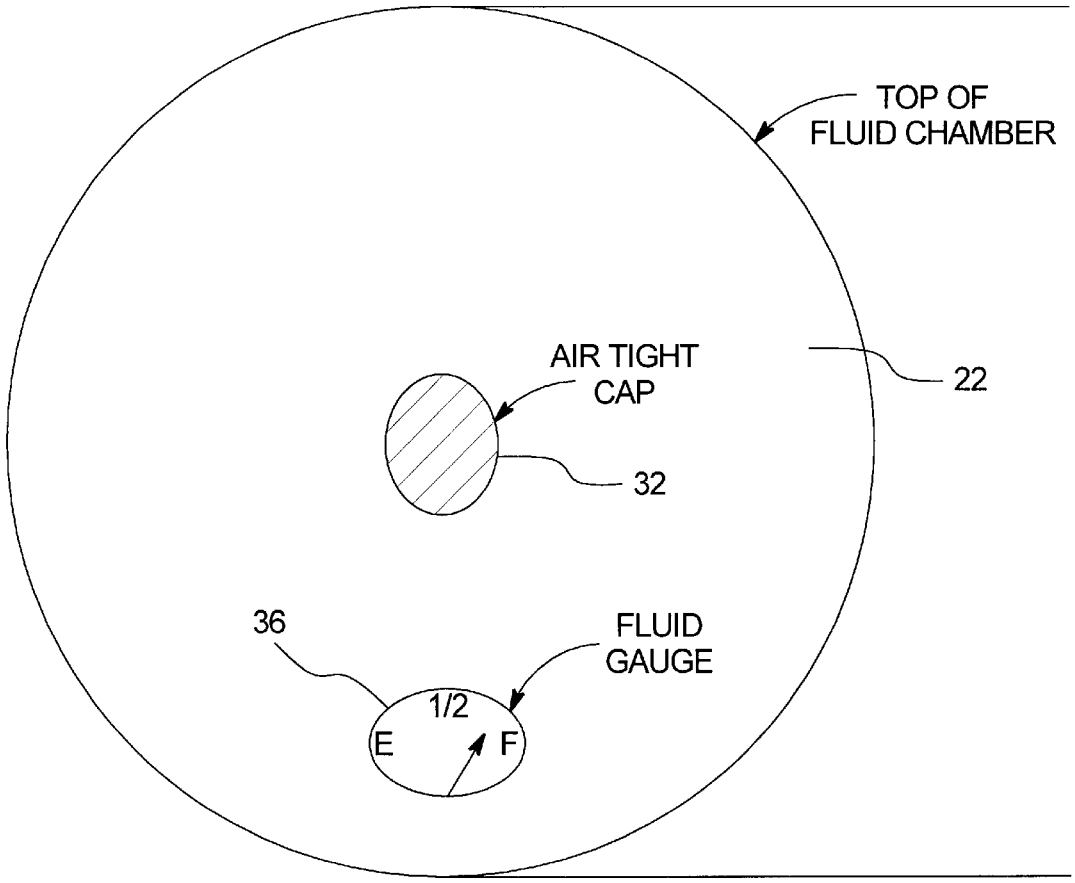
FIG. 2*a* is a top plan view of same

Fluid container 20 has a top surface 22, a bottom surface 24, and a cylindrical wall 26 which together define a chamber 28 as shown in FIG. 2. Access port 30 is located on top surface 22 which is capped with a removably affixed air tight cap 32. Screen 34 is seated within access port 30 and protrudes inwardly from access port 30 into chamber 28 of fluid container 20. Screen 34 filters the fluid entering chamber 28 to prevent debris from entering the system. Fluid gauge 36 indicates the volume of fluid contained with fluid container 20 as shown in FIG. 2*a*. In a preferred embodiment, fluid container 20 has a capacity of about 8 to 10 gallons. Preferably, the fluid container 20 is made of aluminum.

Figure 3:
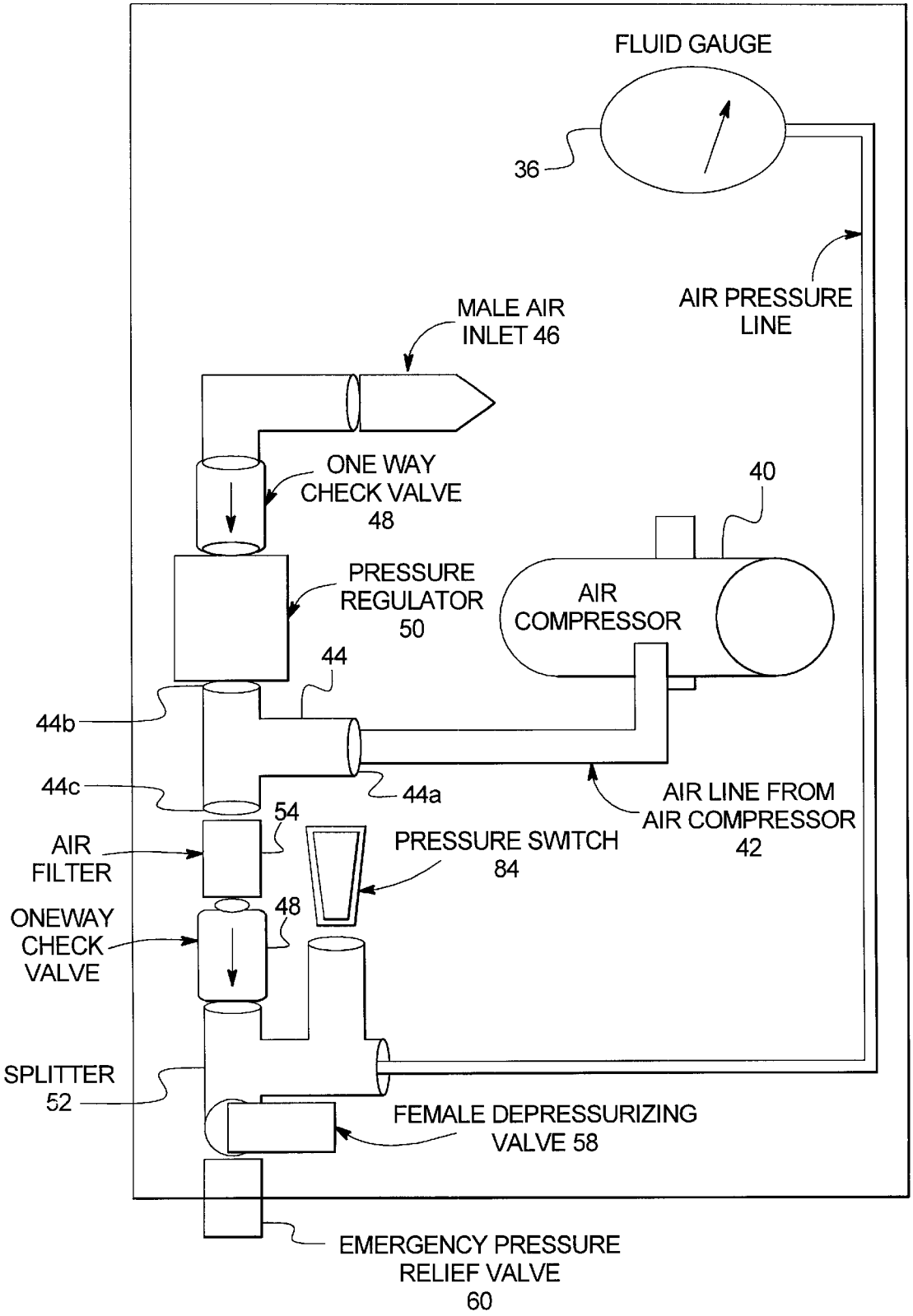
FIG. 3 is a schematic diagram of the pressurizing system.

After the desired amount of fluid is charged, and access port 30 has been capped, fluid container 20 must be pressurized. Fluid container 20 may be pressurized in a number of ways. One method of pressurization is the use of air compressor 40 as shown in FIG. 3. Air compressor 40 pulls air in from the atmosphere and feeds it into chamber 28. Air from air compressor 40 flows through air line 42 to T-joint 44. T-joint 44 receives air from different sources and directs it into chamber 28 of fluid container 20. Three ports are present on T-joint 44, namely, 44*a*, 44*b* and 44*c*. Air line 42 connects the outlet of air compressor 40 to neck 44*a* of T-joint 44.

Chamber 28 may also be pressurized by air from an outside air supply. For example, a workshop may have an air compressor that powers equipment such as air drills. The air line from the workshop compressor can be connected to fluid dispenser 10 to pressurize chamber 28.

Specifically, the workshop compressor air line connects to male air inlet 46. A one way check valve 48 maintains air flow in one direction, i.e., towards chamber 28. Regulator 50 regulates the rate at which shop air enters into the system. Usually, shop air is delivered at 100 to 150 psi. Regulator 50 steps down this high pressure air to about 65 psi. The air then passes through splitter 52 and enters chamber 28 through neck 44*b* of T-joint 44.

Air filter 54 is removably attached to both neck 44*c* of T-joint 44 and air inlet port 56 located on bottom surface 24 of fluid container 20. Air entering chamber 28 from either air compressor 40 or the workshop air compressor is filtered by air filter 54 to remove any contaminants which may be present therein.

Splitter 52 which receives air from the workshop compressor and directs it to chamber 28 is also connected to a depressurizing valve 58 and emergency pressure relief valve 60. Emergency pressure relief valve 60 is set to operate at pressures over 70 psi. Depressurizing valve 58 is manually operated to depressurize chamber 28 so that it may be refilled with fluid.

Figure 4:
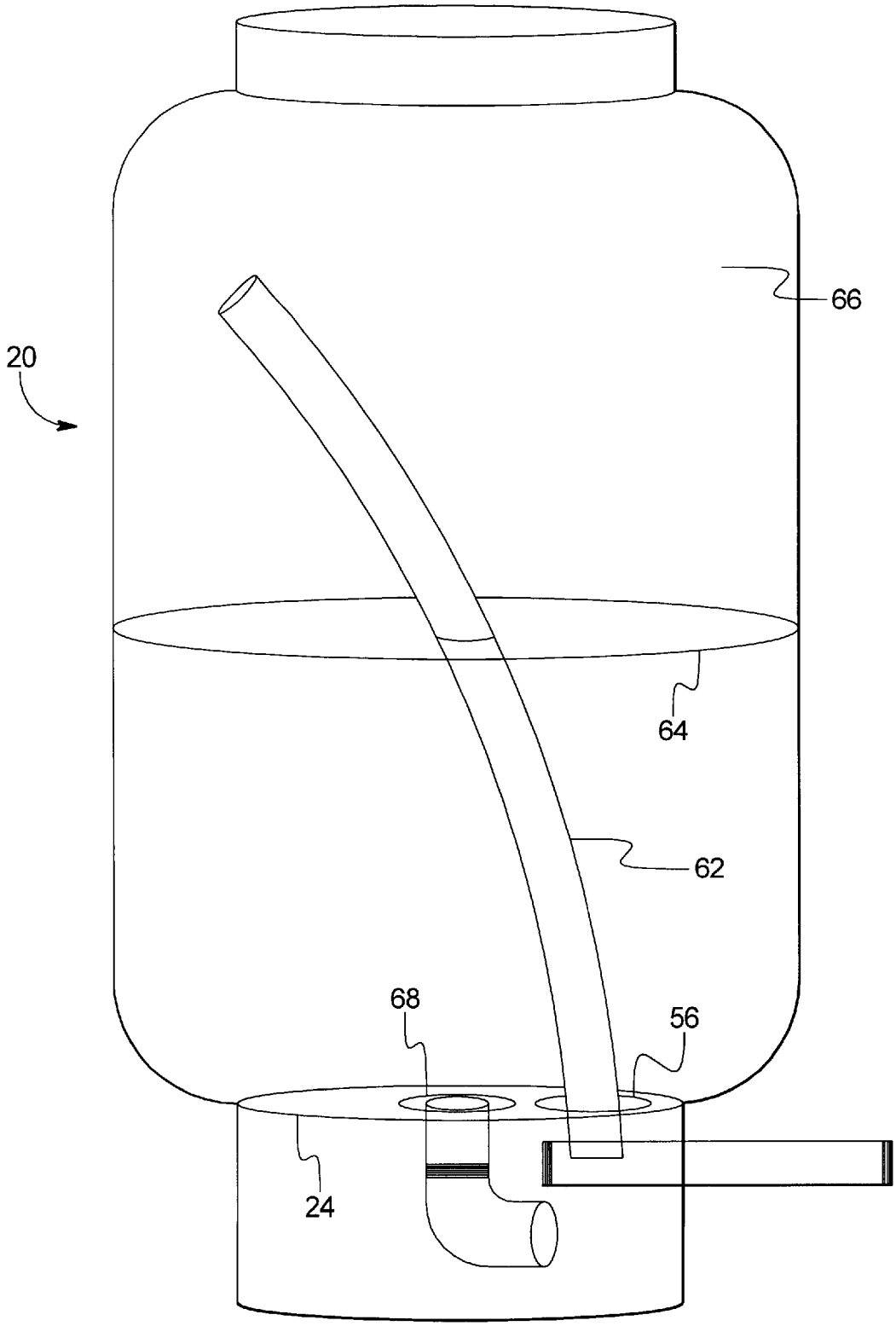
FIG. 4 is a side elevational view of a fluid container.

Air enters chamber 28 through air inlet port 56 and travels up through air tube 62 which is held in an upright position by bracket 64 as shown in FIG. 4. The air accumulates in head space 66 to create a head pressure. The head pressure creates downward force on the fluid contained in chamber 28.

Figure 5:
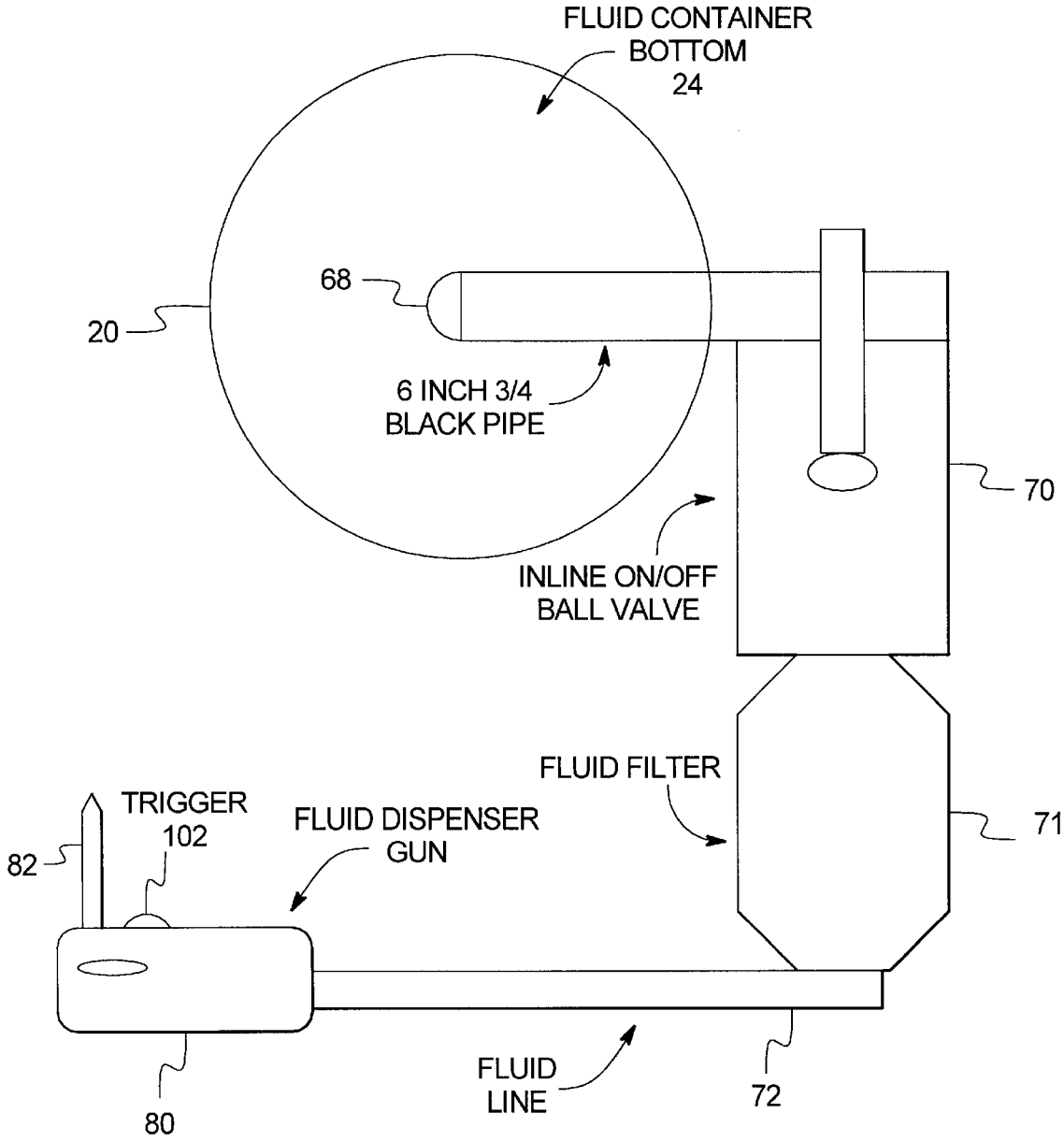
FIG. 5 is a bottom plan view of said fluid container.

Fluid exit port 68 located on bottom surface 24 of fluid container 20 is where fluid exits chamber 28 as shown in FIG. 5. Ball valve 70 is connected to fluid exit port 68 and regulates the outflow of fluid. Specifically, ball valve 70 on dispenser gun 80 serves to shut off fluid in case of a fluid line break. Ball valve 70 is operated manually. Fluid exits chamber 28 through exit port 68 displaced by the positive head pressure. Fluid then flows through fluid filter 71 and fluid line 72 up to dispenser gun 80 from where it is dispensed through nozzle 82.

As fluid is dispensed, pressure decreases because of the increase in volume of head space. This pressure drop is detected by pressure switch 84 which may be located anywhere along the pressurizing air line system. In particular, when the pressure in chamber 28 drops below 60 to 65 psi, pressure switch 84 activates air compressor 40. When the pressure within chamber 28 reaches 65 psi, air compressor 40 is deactivated. In this way, a constant fluid flow rate is achieved.

Figure 6:
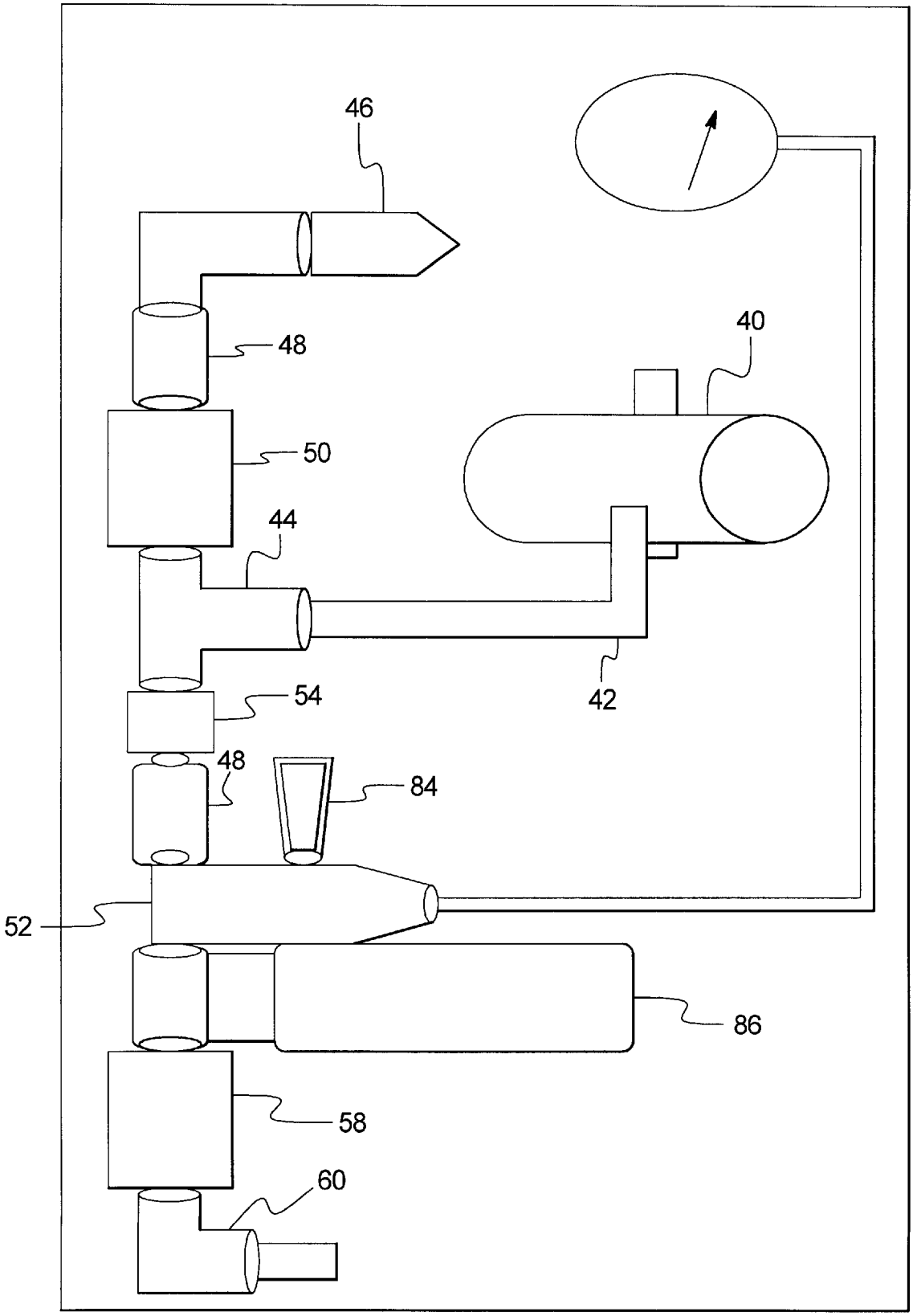
FIG. 6 is another embodiment of said pressurizing system.

To better maintain a constant head pressure, accumulator 86 may be incorporated into the system as shown in FIG. 6. Accumulator 86 reduces the magnitude of pressure fluctuations in the head space and provides a constant head space pressure of 65 psi.

Figure 7:
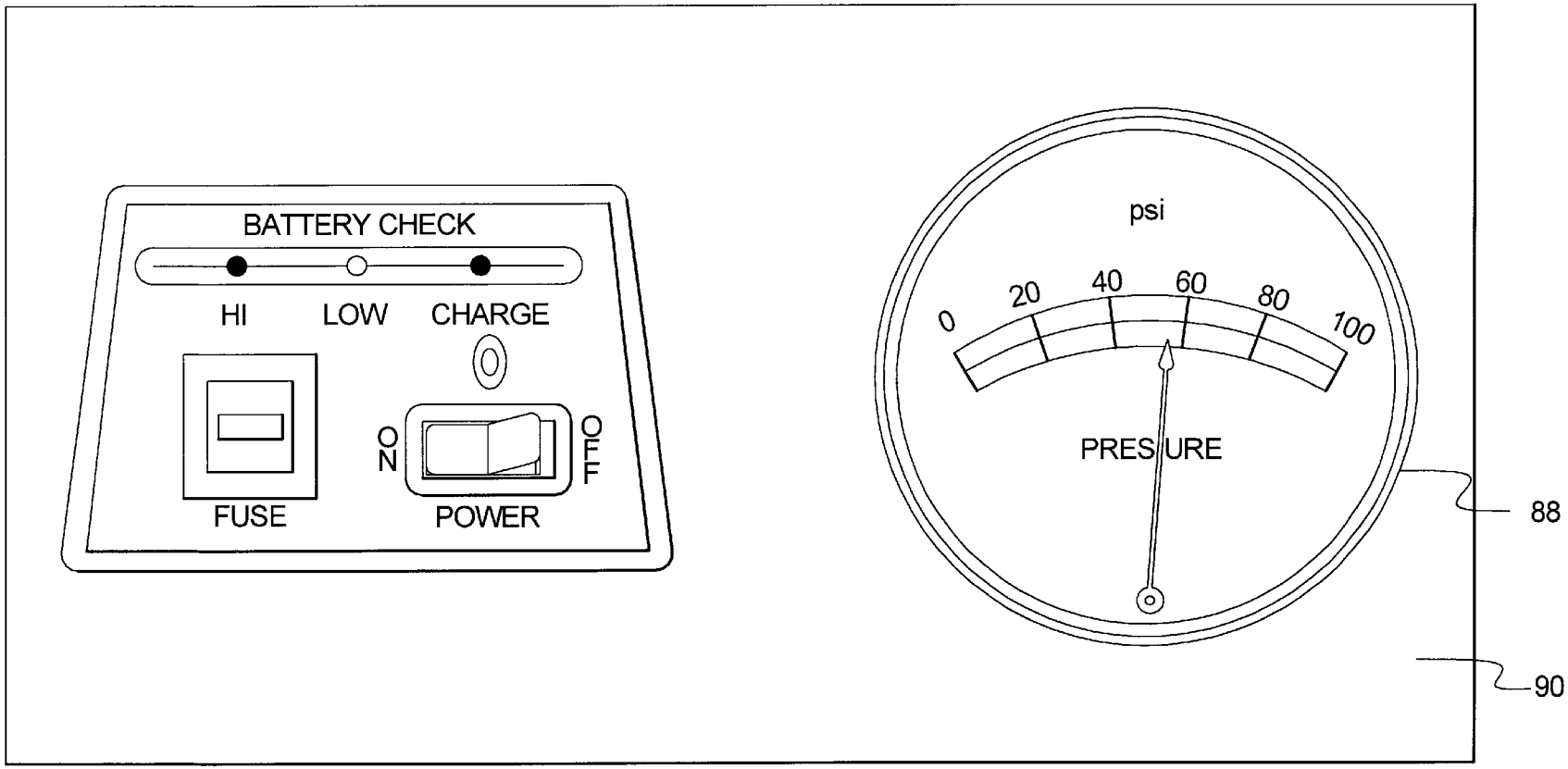
FIG. 7 is a plan view of operating console of said fluid dispenser.

The pressure within fluid container 20 is indicated by pressure gauge 88 located on operating console 90 as shown in FIG. 7.

Figure 8:
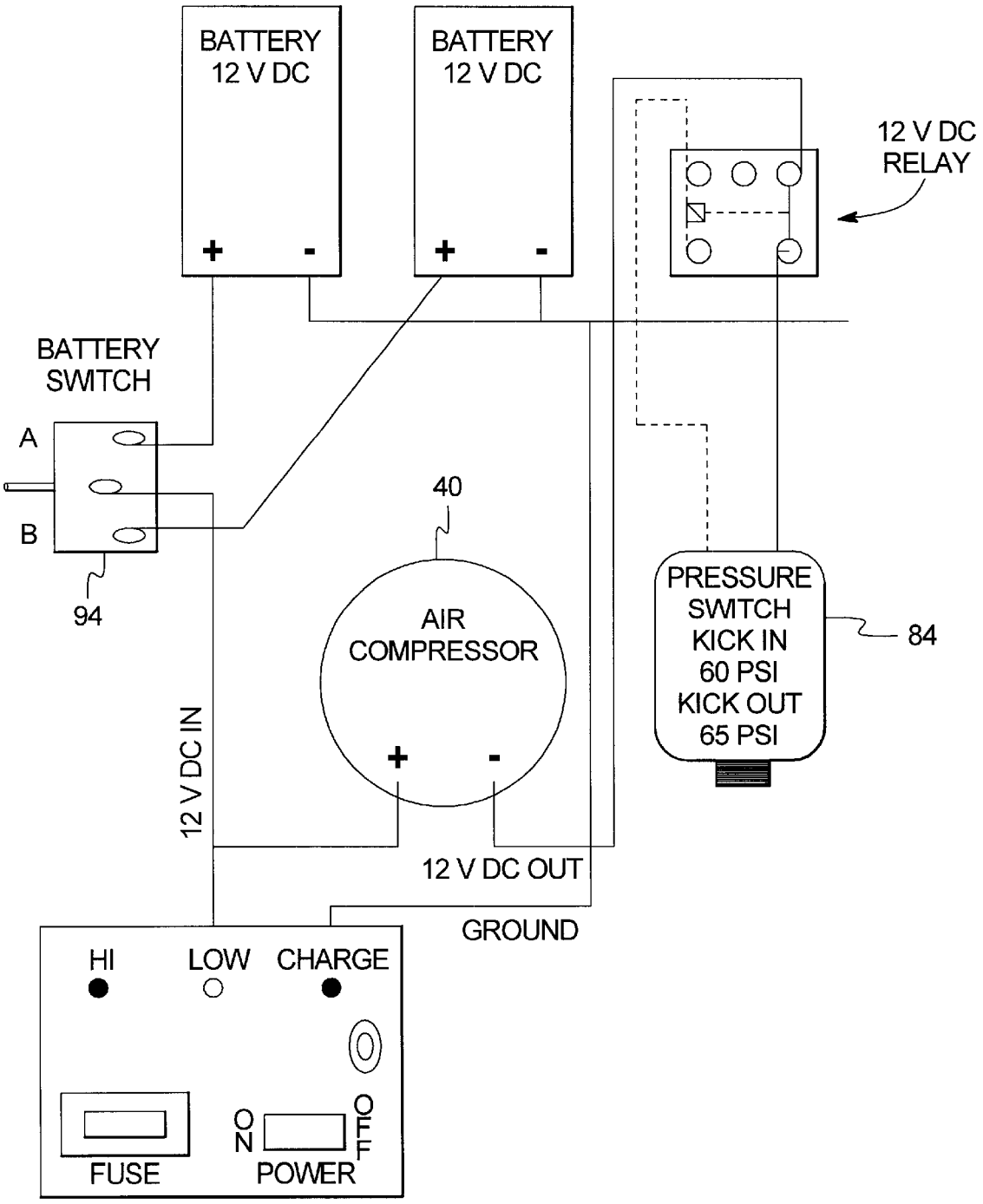
FIG. 8 is a schematic diagram of a dual battery power system.

Air compressor 40 is powered by a rechargeable battery 92. A dual battery system may also be used to power air compressor 40 as shown in FIG. 8. In a dual battery system, a reserve battery can be activated in case the primary battery is drained. A battery selector switch 94 located on operating console 90 allows the operator to select either primary or reserve battery to power air compressor 40. Alternatively, rechargeable battery 92 may be recharged by a solar panel.

Figure 9:
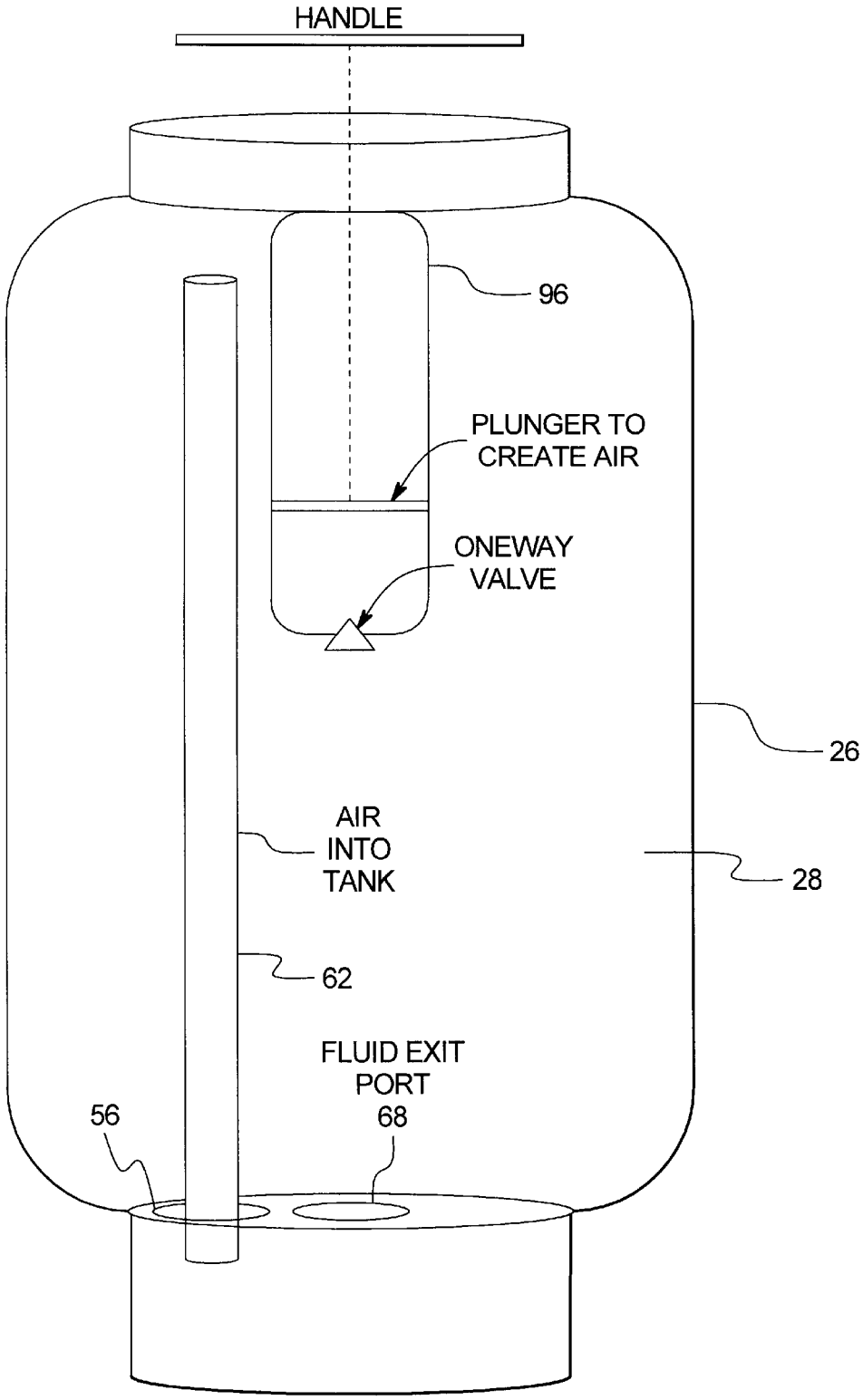
FIG. 9 is a plan view of an alternative embodiment of said pressurizing system.

In another embodiment, fluid container 20 may be pressurized by a manually operated hand pump 96 as shown in FIG. 9. In yet another embodiment, both air compressor 40 and hand pump 96 are present. Hand pump 96 acting as a back-up air supply in case air compressor 40 experiences power or mechanical failure.

Figure 10:
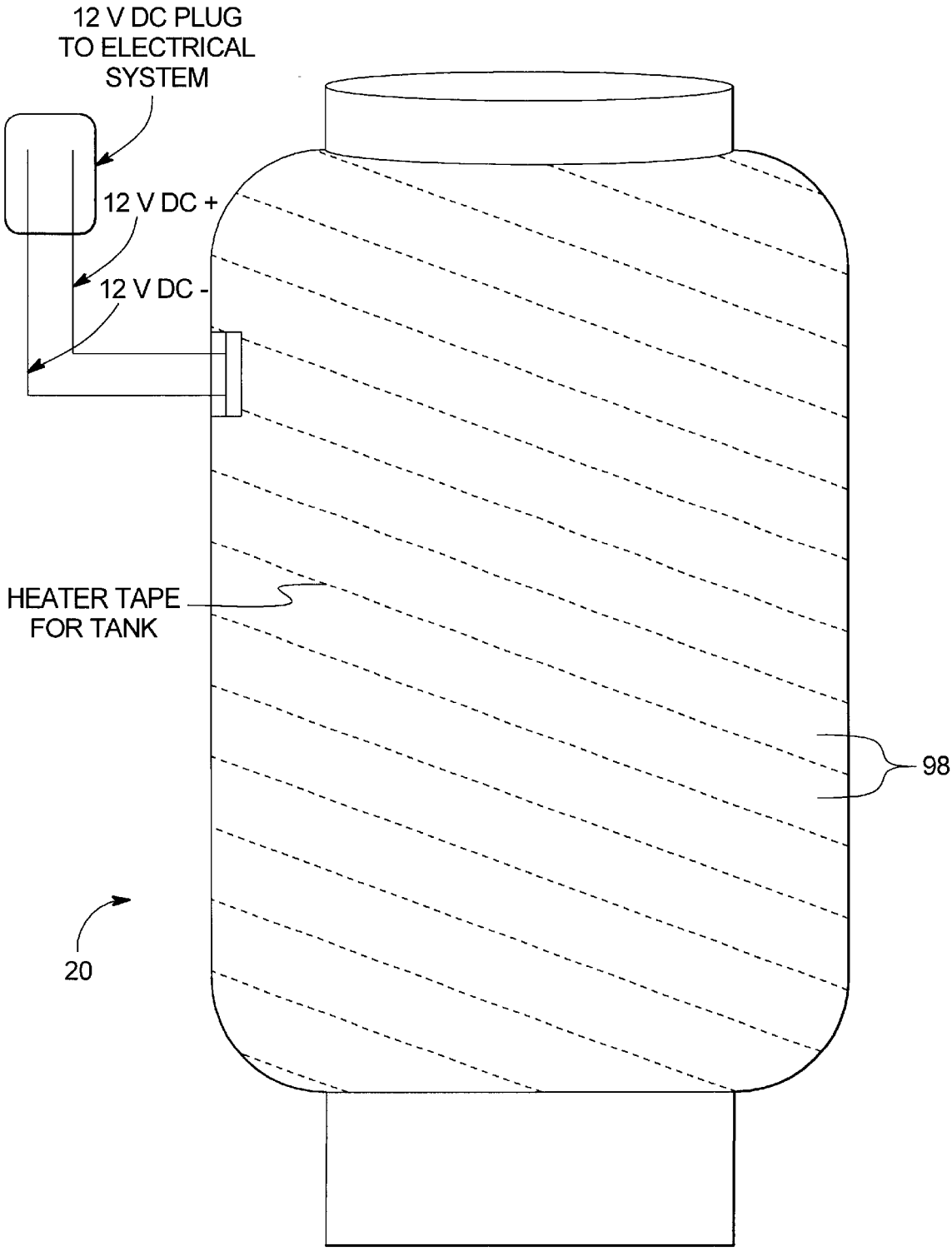
FIG. 10 is an elevational view of an insulated fluid container.

Optionally, fluid container 20 may be insulated to prevent fluid within chamber 28 from freezing or becoming extremely viscous. Heat tape 98 is wrapped around cylindrical wall 26 and is powered by the same power source as air compressor 40 as shown in FIG. 10. A programmable thermostat enables the user to set the desired temperature setting. This option is particularly useful when operating the oil dispenser in colder climates.

It is contemplated that fluids such as motor oil, windshield washer fluid, transmission oil, brake oil, water, steering fluid, gasoline, or any other fluid be delivered by the present invention.

In use, cap 32 is removed and fluid container 20 is filled with a particular fluid through access port 30. The fluid is filtered as it passes through screen 34 to remove any debris that may be present in said fluid. Access port 30 is then capped and compressor 40 is activated by turning switch 100 on console 90 to the "on" position. Gauge 88 on console 90 indicates the pressure within fluid container 20. When the pressure value reaches the predetermined value pressure switch 84 deactivates compressor 40.

Fluid dispenser 10 is then transported to the device to be serviced. Dispenser gun 80 is then positioned for delivery of the fluid contained in fluid container 20. Trigger 102 of dispenser gun 80 is then activated and the fluid is dispensed through nozzle 82. As the fluid is dispensed, the head pressure drops because of the increased head space volume. This pressure drop is detected by pressure switch 84 which then activates compressor 40 to raise the internal pressure back up to the predetermined pressure set point. The fluctuations in pressure are dampened by accumulator 86 which operates to maintain a constant head pressure.

When the fluid contained within fluid container 20 is totally dispensed or depleted it must be replenished. In order to refill fluid container 20 the pressure within chamber 28 must be relieved. Depressurizing valve 58 operates to relieve the residual internal pressure within fluid chamber 28 before attempting to remove cap 32. The fluid is then filled in fluid container 20, the container recapped, the compressor activated and the procedure is repeated as previously mentioned above.

The foregoing description and drawings merely explain and illustrate the invention and the invention is not limited thereto except insofar as the appended claims are so limited, as those skilled in the art who have the disclosure before them will be able to make the modifications and variations therein without departing from the scope of the invention.

I claim:

1. A portable fluid dispenser, comprising:

a fluid reservoir;

an air compressor in communication with said fluid reservoir for pressurizing said fluid reservoir to a predetermined set point;

an air filter interposed between said air compressor and said fluid reservoir;

a pressure switch associated with said fluid reservoir for activating said air compressor when air pressure within said fluid reservoir drops below a predetermined internal pressure;

a regulated inlet in communication with said fluid reservoir for regulating air entering into said fluid reservoir from an alternate air supply;

a power source in electrical communication with said air compressor and said pressure switch for providing electrical power thereto; and a dispenser gun in communication with said fluid reservoir for dispensing fluid contained in said fluid reservoir.

2. A portable fluid dispenser for dispensing a fluid, comprising:

means for containing the fluid;

means for pressurizing said means for containing the fluid to a predetermined set point;

an air filter interposed between said means for containing the fluid and said means for pressurizing said means for containing the fluid;

means for supplying power to said means for pressurizing said means for containing the fluid;

means for activating said means for pressurizing said means for containing the fluid when pressure within said means for containing the fluid drops below a predetermined internal pressure; and means for dispensing the fluid.

3. The portable fluid dispenser of claim 2, wherein said means for containing fluid is a cylindrical metal tank.

4. The portable fluid dispenser of claim 3, wherein said metal tank is an aluminum tank.

5. The portable fluid dispenser of claim 3, wherein said means for containing fluid is a rubber bladder.

6. The portable fluid dispenser of claim 3, wherein said power supply means is a solar power cell.

7. The portable fluid dispenser of claim 3, wherein said power supply means is a portable gas generator.

8. The portable fluid dispenser of claim 3, wherein said pressurizing means is a manually operated hand pump.

9. The portable fluid dispenser of claim 3, wherein said pressurizing means is a connector adapted to connect to an outside air supply.

10. The portable fluid dispenser of claim 2, wherein said pressurizing means is an air compressor.

11. The portable fluid dispenser of claim 2, wherein said power supplying means is a portable rechargeable battery.

12. A portable fluid dispenser comprising:

a fluid reservoir having a top end having a fluid filtering access port;

a bottom end having an air inlet port and a fluid outlet port; and a cylindrical wall;

an air compressor connected to said air inlet port of said fluid reservoir;

a ball valve connected to said fluid outlet port of said fluid reservoir;

a pressure regulator to regulate air pressure entering into said fluid reservoir from said air compressor;

a power source connected to said air compressor;

an adjustable pressure switch to form a circuit between said power source and said air compressor when pressure within said fluid reservoir drops below a predetermined internal pressure set point;

a pressure relief valve to release pressure if it exceeds a predetermined excess pressure set point;

a pressure gauge connected to said fluid reservoir to indicate said internal pressure;

a male air inlet for pressurizing said fluid reservoir from an outside air supply;

a depressurizing valve for depressurizing said fluid reservoir; and a dispenser gun connected to said fluid outlet port of said fluid reservoir.

13. The portable fluid dispenser of claim 12, further comprising an air filter between said air compressor and said fluid reservoir.

14. The portable fluid dispenser of claim 12, further comprising a means for heating said fluid reservoir to a predetermined temperature set point.

15. The portable fluid dispenser of claim 12, further comprising a fluid filter between said fluid reservoir and said dispenser gun.

16. The portable fluid dispenser of claim 12, further comprising an alternate power source.

17. The portable fluid dispenser of claim 16, further comprising an power supply switch to select said alternate power source.

18. The portable fluid dispenser of claim 16, wherein said alternate power source is a rechargeable battery.

19. The portable fluid dispenser of claim 16, wherein said alternate power source is a solar power cell.

20. The portable fluid dispenser of claim 16, wherein said alternate power source is a portable gasoline powered electrical generator.

21. The portable fluid dispenser of claim 12, further comprising a manually operated air supply pump.

22. The portable fluid dispenser of claim 12, further comprising a fluid quantity gauge connected to said fluid reservoir.

23. The portable fluid dispenser of claim 12, wherein said power source is a rechargeable battery.

24. The portable fluid dispenser of claim 12, wherein said power source for charging said rechargeable battery is a solar power cell.

25. The portable fluid dispenser of claim 12, wherein said power source is a portable gasoline powered electrical generator.

* * * * *